United States Patent [19]

Sasaki

[11] Patent Number: 4,579,319

[45] Date of Patent: Apr. 1, 1986

[54] COMBINED SINTERING-ANNEALING FURNACE

[75] Inventor: Nobuyoshi Sasaki, Yokohama, Japan

[73] Assignee: M.C.L. Co., Ltd., Kanagawa, Japan

[21] Appl. No.: 623,365

[22] Filed: Jun. 22, 1984

[30] Foreign Application Priority Data

Jun. 29, 1983 [JP] Japan ..... 58-115787

[51] Int. Cl.[4] ..... F27B 19/02; C21D 9/00

[52] U.S. Cl. ..... 266/252; 266/259; 164/338.1; 164/443

[58] Field of Search ..... 164/338.1, 322, 443, 164/348; 266/259, 252, 249, 105, 200, 160

[56] References Cited

U.S. PATENT DOCUMENTS 4,225,121 9/1980 Meyer et al. ..... 266/130

FOREIGN PATENT DOCUMENTS 134737 3/1979 Fed. Rep. of Germany ... 164/328.1

1586372 3/1981 United Kingdom ..... 164/338.1

*Primary Examiner*—Christopher W. Brody

*Attorney, Agent, or Firm*—Laff, Whitesel, Conte & Saret

[57] ABSTRACT

A combination sintering-annealing furnace is provided, wherein the sintering furnace section and the annealing furnace section are arranged adjacent with each other and separated by a partition wall. A plurality of ventilation windows is provided through the partition wall to allow the waste combustion gas in the sintering furnace to flow into the annealing furnace. The opening area of each ventilation window is adjusted by an adjuster plate. The annealing furnace is also provided with a plurality of cold air inlet ports for introducing therethrough cold air from the atmosphere, the opening area of each cold air inlet port being adjusted by an adjuster plate. A desired temperature distribution in the annealing furnace may be established by controlling the opening areas of the respective ventilation windows and respective cold air inlet ports.

6 Claims, 4 Drawing Figures

10
42
38
36
40a
40b
40c
50b
56a
54a
III
III
30
48
50
52
34
32

COMBINED SINTERING-ANNEALING FURNACE

BACKGROUND OF THE INVENTION

1. Field of Art

The present invention relates to a combination sintering-annealing furnace, and particularly to such a combination furnace wherein the waste heat from the furnace for sintering ceramic shell molds is utilized to establish a desired heat distribution in an adjacent annealing furnace for slowly cooling the cast material contained in the ceramic shell molds.

A cast product prepared, for example, through the lost-wax casting process frequently suffers cracking or other failures particularly at a thin wall portion thereof. Such crackings or fine fissures are caused by the stress in the cast material during the course of cooling, the stress resulting from the difference in shrinkage between the cast material and the mold.

2. Prior Art

It has been proposed to control the cooling rate of the cast material in order to prevent an occurrence of cracking at the thin wall portion of the cast product. In the conventional cooling furnaces used for this purpose, an individual heat source separated from the heat source for the sintering furnace is used or the waste gas from the sintering furnace is passed to the cooling furnace installed away from the sintering furnace at a long distance. A vast investment is required for the blower means and the heat-insulated piping equipment in the conventional plant for combining the sintering furnace with the cooling furnace, in addition to a complicated design task requested for the establishment of optimum heat distribution in the cooling furnace.

OBJECTS AND SUMMARY OF THE INVENTION

A primary object of this invention is to provide a combination sintering-annealing furnace for preparing sintered ceramic shell molds and for slowly cooling the cast material contained in the molds.

Another object of this invention is to provide such a combination sintering-annealing furnace to eliminate the needs of a separate heat source, blower means and expensive piping for the cooling furnace.

A further object of this invention is to provide such a combination sintering-annealing furnace to save energy, investment and space for the cooling furnace.

To attain the above and other objects of this invention, the combination sintering-annealing furnace of the invention comprises a sintering furnace for sintering therein ceramic shell molds and having a combustion gas discharge duct, an annealing furnace for slowly cooling cast material contained in said ceramic shell molds and having a hot air discharge duct and a plurality of adjustable cold air inlet ports, the annealing furnace being disposed adjacent to the sintering furnace and separated from the sintering furnace by a partition wall having a plurality of adjustable ventilation windows for introducing therethrough hot air from said sintering furnace.

DESCRIPTION OF THE DRAWINGS

The features of the invention will be fully understood from the detailed description of the invention with reference to the appended drawings wherein.

DESCRIPTION OF THE PREFERRED EMBODIMENT

Figure 1:
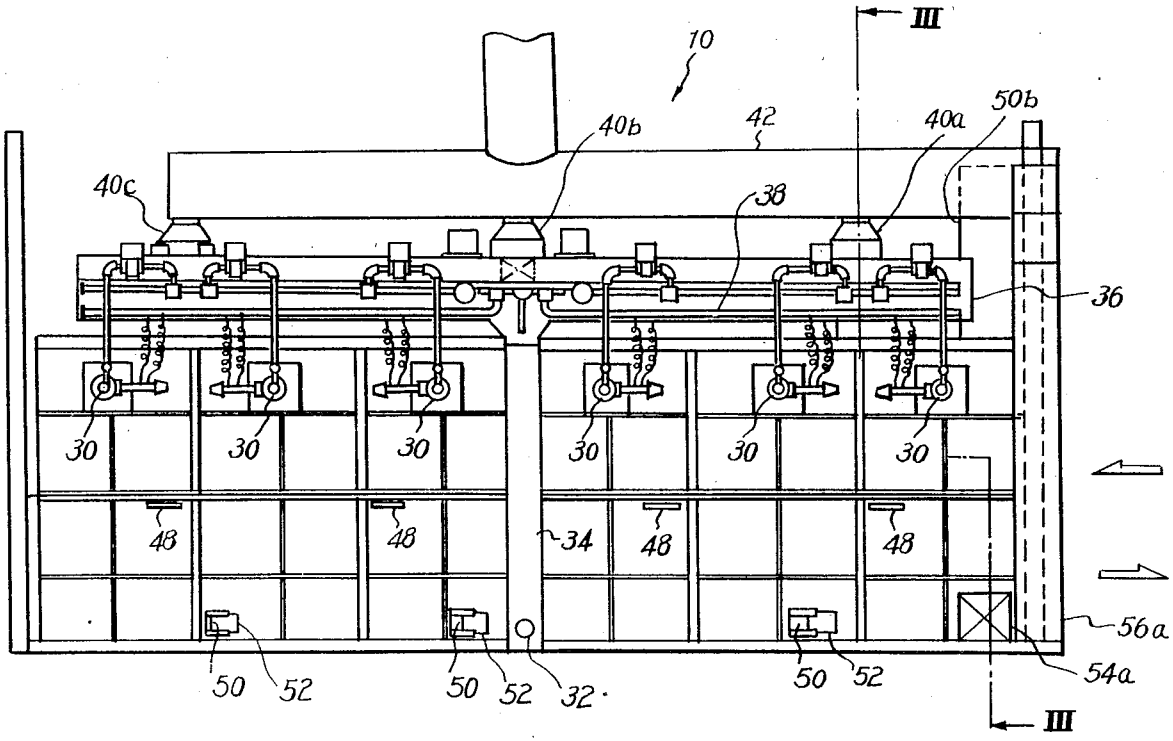
FIG. 1 is a side elevation of an embodiment of the invention.
Figure 2:
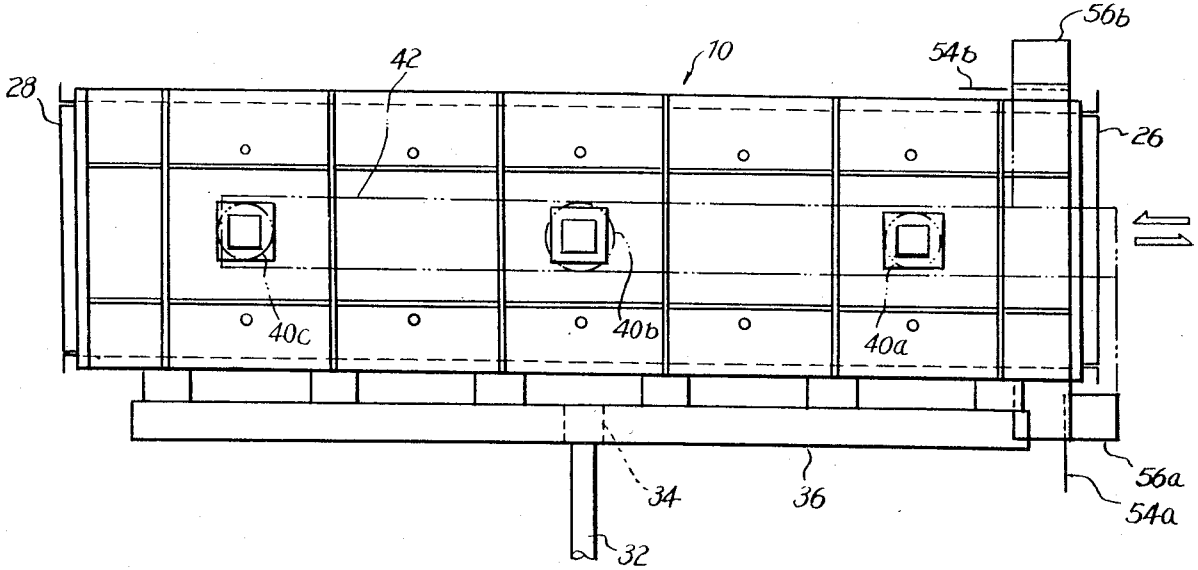
FIG. 2 is a plan view of the embodiment shown in FIG. 1.
Figure 3:
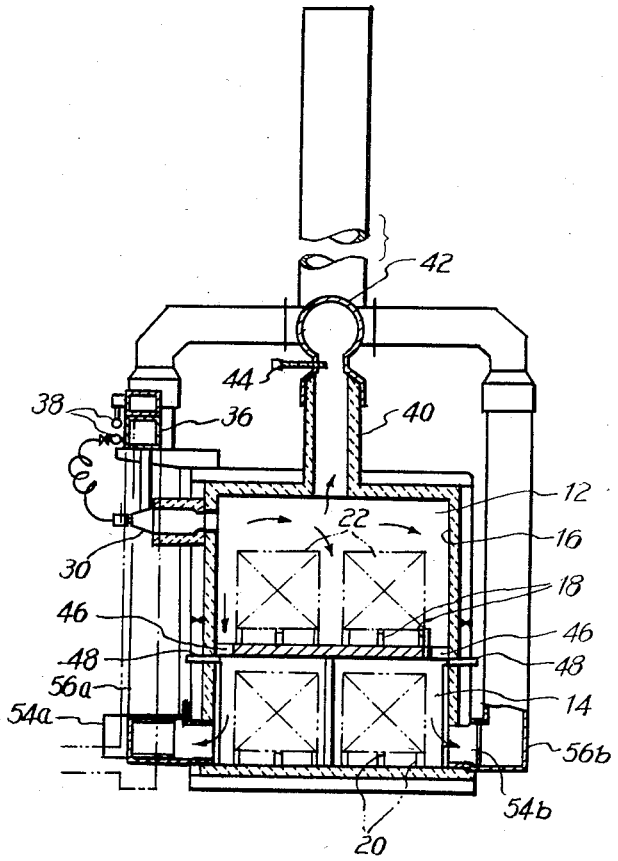
FIG. 3 is a cross-sectional view taken along line III—III of FIG. 1.
Figure 4:
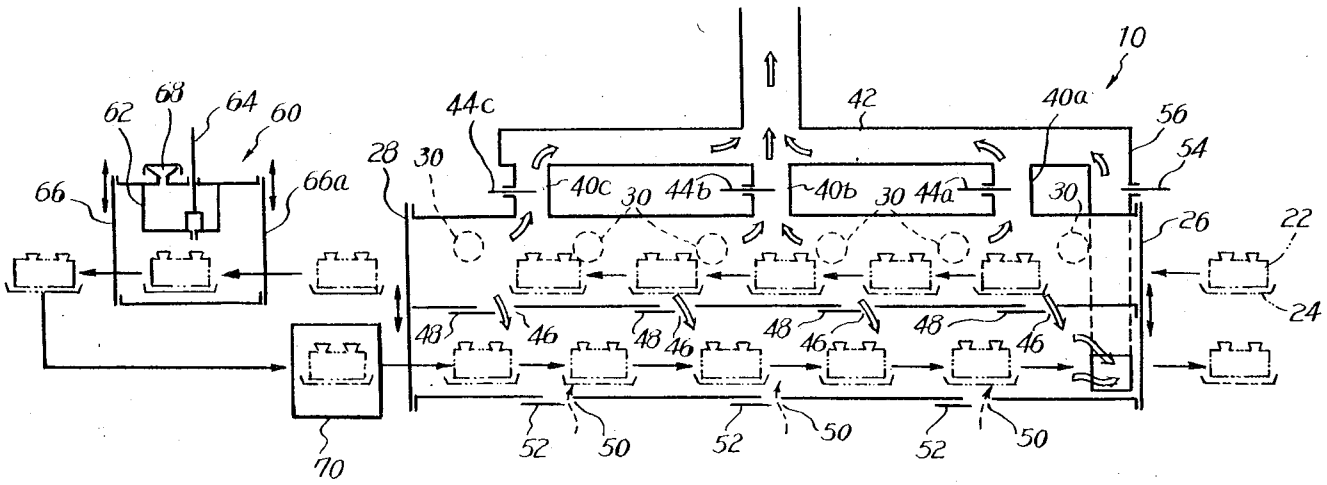
FIG. 4 is a schematic illustration showing the operation of the embodiment shown in FIGS. 1 to 3.

A preferred embodiment of the invention is shown in FIGS. 1 to 4, wherein a sintering-annealing furnace 10 includes an upper sintering furnace 12 and a lower annealing furnace 14. The furnaces 12 and 14 are of a tunnel-like shape and are insulated from the atmosphere by heat-insulators 16, as best seen from FIG. 3. The furnaces 12 and 14 extend adjacent and parallel to each other. Although the annealing or cooling furnace 14 extends beneath the sintering furnace 12 in the illustrated embodiment, the furnace 14 may be disposed over the sintering furnace 12. Conveyor means 18 and 20 (see FIG. 3) are provided, respectively, in the sintering and annealing furnaces 12 and 14, so that green ceramic shell molds 22 placed on respective pallets 24 (see FIG. 4) are moved through the furnace 12 in one direction by the conveyor means 18 and sintered ceramic shell molds 22 containing cast material are moved through the furnace 14 in the reverse direction by the conveyor means 20, as seen from FIG. 4. The openings at the ends of the sintering-annealing furnace 10 are closed and opened by moving the door plates 26 and 28 (see FIGS. 2 and 4) in the vertical direction.

A plurality, six in the illustrated embodiment, of gas burners 30 are attached on one side wall of the sintering furnace 12. Air supplied by an air blower (not shown) through air supply ducts 32, 34 and 36 is mixed with a combustible gas supplied through a gas supply pipe 38, and the mixed gas is ignited by the electric ignition plug of each gas burner 30. Three combustion gas discharge ducts 40*a*, 40*b* and 40*c* extend through the top wall of the sintering furnace 12, and a portion of the combustion gas is discharged through the ducts 40*a*, 40*b* and 40*c* to flow into a horizontal discharge duct 42 to be removed from the system. Each of the ducts 40*a*, 40*b* and 40*c* is provided with a damper 44 (44*a*, 44*b*, 44*c*) for adjusting the open area to control the amount of discharged combustion gas.

The sintering furnace 12 and the annealing furnace 14 are separated by a partition wall provided with a plurality of ventilation windows 46, four pairs of ventilation windows 46 being formed along the longitudinal direction of the partition wall in the illustrated embodiment. The open area of each ventilation window 46 may be adjusted by an adjuster plate 48. A plurality of cold air inlet ports 50 is provided through the side walls of the annealing furnace 14, three for each of the right and left side walls being provided in the illustrated embodiment. The open area of each of the cold air inlet ports 50 is also adjustable by setting each of the adjuster plates 52 at an appropriate position.

Air discharge ducts 56 (56*a*, 56*b*) are formed through the side walls of the annealing furnace 14 at the downstream extremity thereof. Dampers 54 (54*a*, 54*b*) are provided at the outlets to the air discharge ducts 56 to control the amount of air discharged through the ducts 56. The upper ends of the ducts 56 are connected to the horizontal duct 42.

In operation, the sintering-annealing furnace 10 is combined with a casting apparatus 60 and a rapid cooling apparatus 70. The casting apparatus combined with the illustrated embodiment is an apparatus for casting magnesium alloy (herein referred to as MG-alloy) in a vacuum, wherein the molten alloy in a ladle 62, which is provided with an electric heating means, is poured into a mold 22 positioned beneath the ladle 62 by raising a valve rod 64 to open the valve port. Reference numerals 66*a* and 66*b* designate door plates of the casting chamber 60. Cold air is blown onto the mold 22 containing the cast molten alloy through spot coolers in the rapid cooling apparatus 70 for an appropriate time.

The illustrated embodiment is operated as follows. The door plate 26 is raised to open the inlet opening of the sintering furnace 12, and a dewaxed mold 22 carried by a pallet 24 is put into the sintering furnace 12. The inside of the sintering furnace 12 is heated by the burners 30. When a magnesium alloy available under the trade name AZ-91 is used, the mold 22 is preferably maintained at a temperature which is lower than about 700° C. and the molten alloy is preferably cast at a temperature of about 750° C. in the casting chamber 60, since the mold 22 may be prepared by the use of a slurry commonly used for the mold for casting an aluminum alloy. Nevertheless it is considered necessary to use a slurry containing a smaller amount of silica ($SiO_2$) for the preparation of a mold for casting an Mg-alloy in order to prevent the metal-mold reaction between the molten Mg-alloy and the mold. The slurry commonly used for the preparation of the mold for casting an Al-alloy may be conveniently used as a mold for casting an Mg-alloy by controlling the temperature of the mold and the casting temperature as aforementioned.

The Mg-alloy is melted and contained in a melting furnace (not shown) at about 800° C. with the surface of the molten mass covered by a smelting flux to prevent the molten alloy from burning.

The molten alloy is fed from the melting furnace to the ladle 62 of the casting apparatus 60 as fast as possible. A small amount of a smelting flux is added to cover the surface of the molten alloy in the ladle 62. After the temperature of the molten alloy in the ladle 62 is lowered to the predetermined temperature of about 740° to 700° C., the door plate 28 of the sintering furnace 12 is opened to transfer the mold 22 maintained at a temperature of about 700° C. Then, a strainer is put on the sprue port of the mold 22. It is desirable for that the mold 22 to have a bottom pouring gating so that the molten alloy is poured from the bottom of the mold 22 to be filled upwardly in the mold 22. Then, the door plates 66*a* and 66*b* are closed and the inlet port 68 of the ladle 62 is sealingly closed by putting a lid thereon. The pressure in the casting chamber 60 is reduced by about 650 mmHg by means of a vacuum pump (not shown). When the pressure in the casting chamber is reduced to the desired level, the vacuum pump is stopped and sulfur hexafluoride ($SF_6$) gas is fed in the casting chamber 60 to establish an inert gas atmosphere in the chamber. At the time when the pressure in the casting chamber reaches the predetermined pressure, a valve rod 64 is raised to open the valve port to complete the casting operation as soon as possible. After the completion of the casting operation, the feeding of $SF_6$ gas is stopped and air is introduced from the atmosphere into the casting chamber 60. The sprue port of the mold is covered by a flux.

The mold 22 containing the cast molten alloy is then transferred to the rapid cooling apparatus 70, by a not-shown conveyer, where the cast alloy is forcibly cooled from the outside of the mold 22. As a result of this forcible and rapid cooling, the portion of the cast alloy contacting with the ceramic shell mold 22 is solidified to form a shell-like soldified skin. Solidification of the cast alloy propagates from the outermost skin portion while being prevented from the formation of a cavity under the hot top effect to form a fine crystalline structure.

A cast product having a thick wall may be cooled to a low temperature only by the rapid cooling apparatus 70. However, if the cast product has a thin wall thickness or uneven wall thickness, the thin wall portion of the product tends to be cracked due to stress developed during the solidification step or by the interference by the mold 22. In order to prevent the occurrence of cracking, the cast mass should be slowly cooled to obviate any excessive temperature difference between the mold 22 and the central portion of the cast mass, particularly within the temperature range of from 565° C. to 470° C., since a significant volume change occurs in response to the shrinkage due to a phase shift within the aforementioned temperature range during the course of solidification of the Mg-alloy. Accordingly, it is recommended to cool the cast alloy rapidly to a temperature of about 570° C. in the rapid cooling apparatus 70, followed by a slow cooling in the annealing furnace 14.

Since the gases in the annealing furnace 14 are sucked through the ducts 56 by the action of the discharged flue gas, the suction pressure being adjusted by changing the opening degree of the dampers 44 and 54, the hot combustion gas is introduced through the ventilation windows 46 and cold atmospheric air is introduced through the air inlet ports 50 into the annealing furnace 14. The temperature distribution in the annealing furnace 14 may be controlled by means of the dampers 44 and 54 and the adjuster plates 48 and 52. The waste heat from the sintering furnace 12 is, thus, effectively utilized for establishing an optimum temperature distribution in the annealing furnace 14 without the need for any blower means.

The building lot or area required for the installation of the sintering furnace and the annealing furnace can be decreased, according to the illustrated embodiment, since the sintering furnace 12 is disposed on the annealing furnace 14. However, the furnaces 12 and 14 may be arranged on the same horizontal plane while being separated by a vertical partition wall extending therebetween or the annealing furnace 14 may be disposed on the sintering furnace 12, without departing from the broad scope of the invention.

What is claimed is:

1. A combined sintering-annealing furnace, comprising a sintering furnace for sintering therein ceramic shell molds and having a combustion gas discharge duct, an annealing furnace for slowly cooling a cast material contained in said ceramic shell molds and having an air discharge duct and a plurality of adjustable cold air inlet ports, said annealing furnace being disposed adjacent to said sintering furnace and separated from said sintering furnace by a common partition wall having a plurality of adjustable ventilation windows for introducing therethrough hot air from said sintering furnace whereby temperature distribution in the annealing furnace is controlled by adjusting open areas of said adjustable ventilation windows and said adjustable cold air inlet ports.

2. The combination sintering-annealing furnace according to claim 1, wherein said air discharge duct of said annealing furnace is in communication with said combustion gas discharge duct of said sintering furnace.

3. The combination sintering-annealing furnace according to claim 1, wherein said sintering furnace includes a plurality of gas burners for raising the temperature therein to a desired temperature.

4. The combination sintering-annealing furnace according to claim 2, wherein said sintering furnace includes a plurality of gas burners for raising the temperature therein to a desired temperature.

5. The combination sintering-annealing furnace according to claim 1, wherein said cast material is a magnesium alloy and wherein the temperature distribution in said annealing furnace is controlled to cool said magnesium alloy slowly at least within the temperature range of 565° C. to 470° C.

6. The combination sintering-annealing furnace according to claim 2, wherein said cast material is a magnesium alloy and wherein the temperature distribution in said annealing furnace is controlled to cool said magnesium alloy slowly at least within the temperature range of from 565° C. to 470° C.

* * * * *